US006162089A

United States Patent [19]

Costello et al.

[11] Patent Number: 6,162,089

[45] Date of Patent: Dec. 19, 2000

[54] STACKED LAN CONNECTOR

[75] Inventors: Brian Patrick Costello, Scotts Valley; Benjamin Jacobson, San Jose; Jason M'Cheyne Reisinger, Mountain View, all of Calif.; Michael S. Abbott, HighPoint; Barry D. Holtzclaw, Winston-Salem, both of N.C.

[73] Assignee: The Whitaker Corporation, Wilmington, Del.

[21] Appl. No.: 09/186,527

[22] Filed: Nov. 5, 1998

Related U.S. Application Data

[60] Provisional application No. 60/070,031, Dec. 30, 1997.

[51] Int. Cl.[7] ..... H01R 13/73; H01R 1/01

[52] U.S. Cl. ..... 439/541.5; 29/832; 29/836; 29/842

[58] Field of Search ..... 439/541, 541.5, 439/490, 607, 540, 1, 638–639, 608–610, 676; 29/825, 832, 836, 842, 840

[56] References Cited

U.S. PATENT DOCUMENTS

| | | | |
|---|---|---|---|
| 4,978,317 | 12/1990 | Pocrass | 439/490 |
| 5,037,330 | 8/1991 | Fulponi et al. | 439/540 |
| 5,094,631 | 3/1992 | Suzuki | 439/676 |
| 5,178,563 | 1/1993 | Reed | 439/676 |
| 5,186,647 | 2/1993 | Denkmann et al. | 439/395 |
| 5,269,708 | 12/1993 | DeYoung et al. | 439/676 |
| 5,281,169 | 1/1994 | Kiat et al. | 439/607 |
| 5,282,754 | 2/1994 | Kish et al. | 439/108 |
| 5,362,257 | 11/1994 | Neal et al. | 439/676 |
| 5,531,612 | 7/1996 | Goodall et al. | 439/541.5 |
| 5,601,451 | 2/1997 | Droines et al. | 439/490 |
| 5,613,873 | 3/1997 | Bell, Jr. | 439/490 |
| 5,639,267 | 6/1997 | Loudermilk | 439/701 |
| 5,685,737 | 11/1997 | Morin et al. | 439/490 |
| 5,797,770 | 8/1998 | Davis et al. | 439/607 |

FOREIGN PATENT DOCUMENTS

| | | | |
|---|---|---|---|
| WO 97/06584 | 2/1997 | WIPO | H01R 23/02 |
| WO 97/10628 | 3/1997 | WIPO | H01R 23/68 |

OTHER PUBLICATIONS

U.S. Serial No. 08/681,576, filed Jul. 29, 1996 (Abstract and drawings only).

U.S. Serial No. 08/829,919, filed Apr. 1, 1997 (Abstract and drawings only).

Brochure, Single Port RJ vista RJHS Hight Speed RJ–45 Modular Jack; date unknown; 1 page; Amphenol Canada Corp., Canada.

Brochure, "Modular Jack Connectors Maxconn MLJ Series"; date unknown; 1 page; MAXCONN Inc., San Jose, CA.

AMP Drawing No. 348518, "Top Row Insert PJ45 8 Way Assy. Loose Pieced and Latched"; 1 page; Oct. 23, 1993; AMP of Great Britain Ltd., Middlesex, England.

AMP Drawing No. 569205, "Term Array Assy, Upper, Rtang, Stacked JK, 8 Posn, Cat 5"; 1 page; Jun. 2, 1995; AMP Incorporated, Harrisburg, PA.

*Primary Examiner*—Paula Bradley
*Assistant Examiner*—Antoine Ngandjui

[57] ABSTRACT

Stacked LAN connector (10) adapted for mounting to a circuit board (24) and including a stacked USB component (150) and a modular jack component (200) secured in respective portions of main housing (50), around which is an outer shield (32). An inner shield (130) shields the arrays of contacts of the modular jack component (200) and the stacked USB component (150) as they depend from the board mounting face to be connected to circuits of the circuit board (24). LEDs (28,30) indicate full mating by a modular plug with the modular jack component. The connector saves board real estate otherwise occupied by a modular jack positioned beside a stacked USB connector on the circuit board.

26 Claims, 9 Drawing Sheets

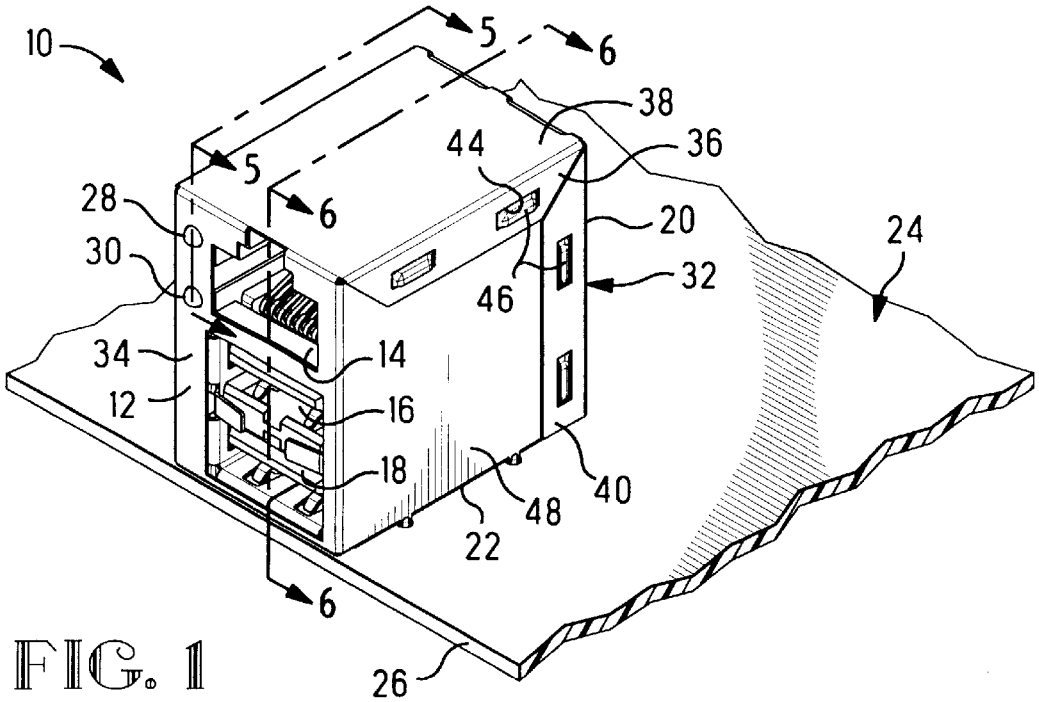
FIG. 1
FIG. 8
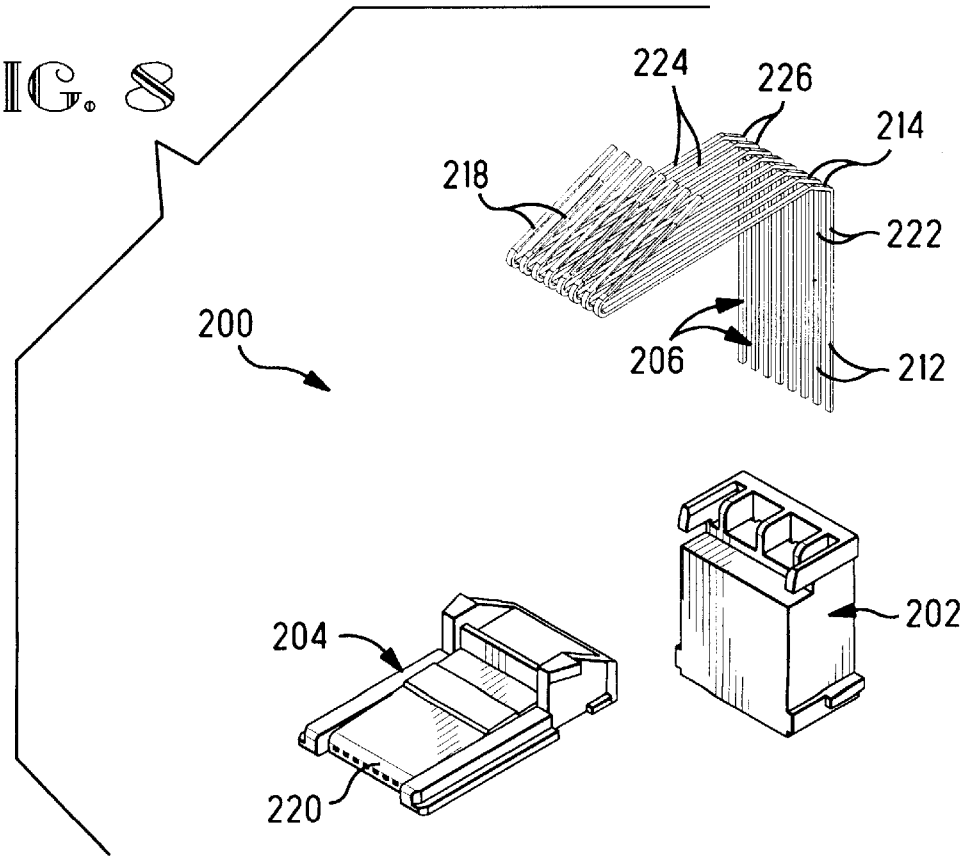

STACKED LAN CONNECTOR

This application claims the benefit of U.S. Provisional Application No. 60/070,031, filed Dec. 30, 1997.

FIELD OF THE INVENTION

This relates to the field of electrical connectors and more particularly to connectors mountable onto circuit boards.

BACKGROUND OF THE INVENTION

Electronic apparatus such as a computer is required to provide connectors at input/output ports that accommodate mating with a plurality of external cables, with the internal connectors conventionally mounted onto a circuit board. One such connector is disclosed in PCT Patent Publication No. WO 97/10628, to be a shielded Serial Bus receptacle connector providing a pair of plug-receiving cavities for mating with two Serial Bus plug connectors simultaneously, for a Local Area Network (LAN). It is also common that the computer provide at the I/O port a modular jack connector matable with modular plug connectors of a design standard in telephony. It is also known from U.S. Pat. Nos. 4,978,317 and 5,685,737, to provide modular jacks with LEDs along the observable mating face at the I/O port as visual indicators of full mating with a plug connector with the modular jack.

SUMMARY OF THE INVENTION

The present invention provides a LAN connector having a pair of plug-receiving cavities stacked beneath a modular jack, so that the connector assembly is matable with a modular plug and, for example, two Universal Serial Bus (USB) plug connectors simultaneously, while occupying only incrementally more circuit board real estate than would be taken up by a stacked USB receptacle. The assembly also provides a pair of LEDs at the mating face that visually indicate at the I/O port whether or not a modular plug is fully mated. Shielding is provided surrounding the assembly above the circuit board and also between the modular jack and its contacts and the USB receptacle and its contacts.

In one embodiment, the LEDs are embedded within a module such that the leads thereof extend from a bottom of the module for soldering to a circuit board. The module is then affixed in a complementary recess of the housing.

Embodiments of the invention will now be disclosed by way of example with reference to the accompanying drawings.

BRIEF DESCRIPTION OF THE DRAWINGS

FIG. 1 is an isometric view of the stacked LAN connector of the present invention mounted onto a circuit board;

FIG. 8 is an exploded isometric view of the modular jack component;

DETAILED DESCRIPTION

Figure 2:
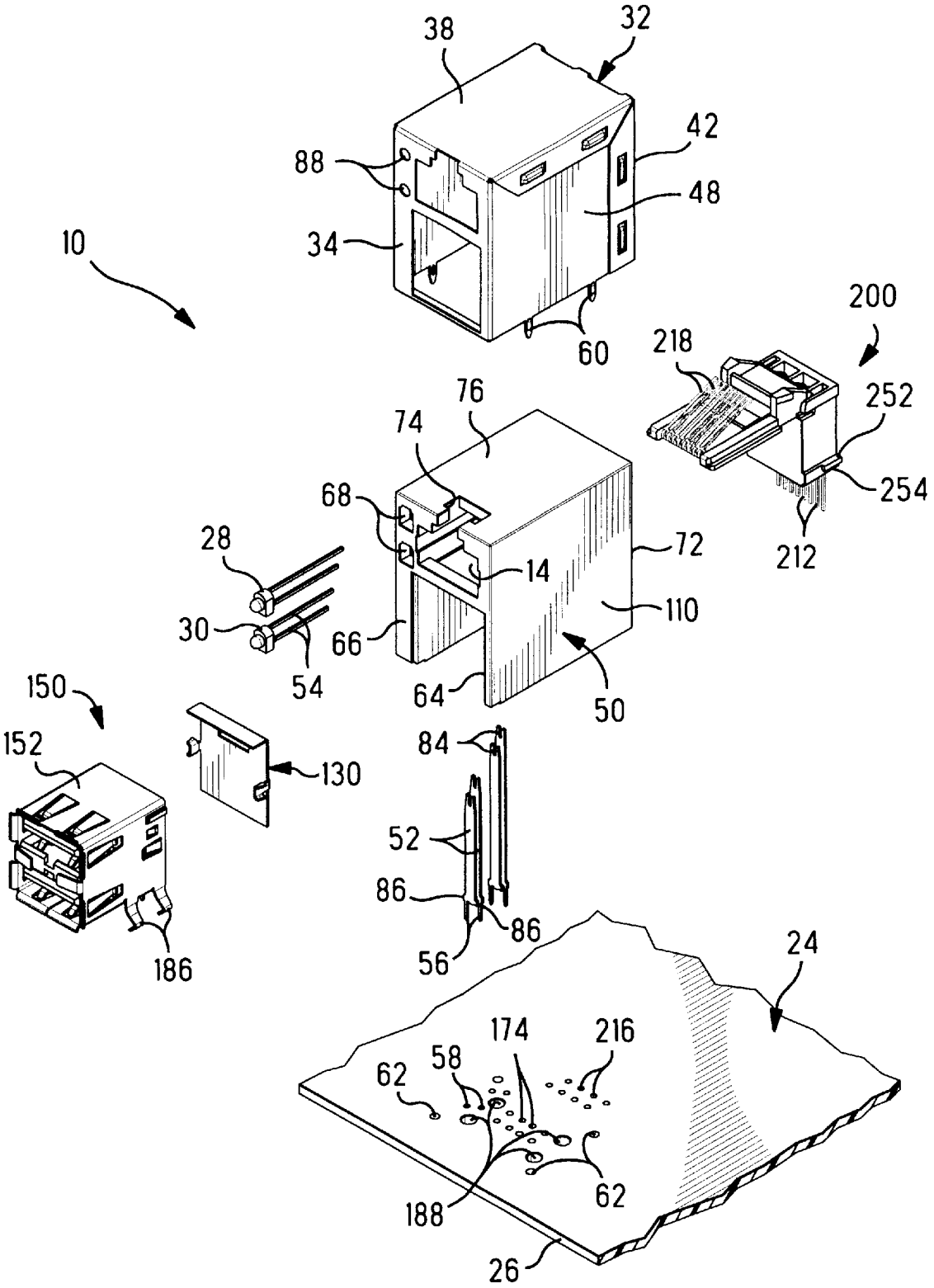
FIGS. 2 and 3 are exploded isometric views of the connector of FIG. 1 from forwardly and rearwardly thereof.

Stacked LAN connector 10 of the present invention is seen in FIG. 1 having a mating face 12 providing a modular plug-receiving cavity 14 and two USB plug-receiving cavities 16,18 extending rearwardly toward rear face 20. Connector 10 includes a board-mounting face 22 orthogonal to both mating face 12 and rear face 20, for mounting to circuit board 24 along an edge 26 thereof. Also seen in FIG. 1 are two light-emitting devices (LEDs) 28,30 beside modular plug-receiving cavity 14 for visually indicating full mating of a modular plug connector (not shown) thereinto. An outer shield 32 is seen enveloping connector assembly 10 and having a front wall 34 along mating face 12, and is appropriately apertured to expose modular plug-receiving cavity 14 and USB plug-receiving cavities 16,18 and also the lenses of LEDs 28,30. Flaps 36 of top shield wall 38 and flaps 40 of rear shield wall 42 (FIG. 3) include slots 44 that lock over embossments 46 of side shield walls 48, to secure thereto as the top and rear walls are bent around the main housing and the flaps are bent to coextend along side walls 48 at the completion of connector assembly.

Figure 3:
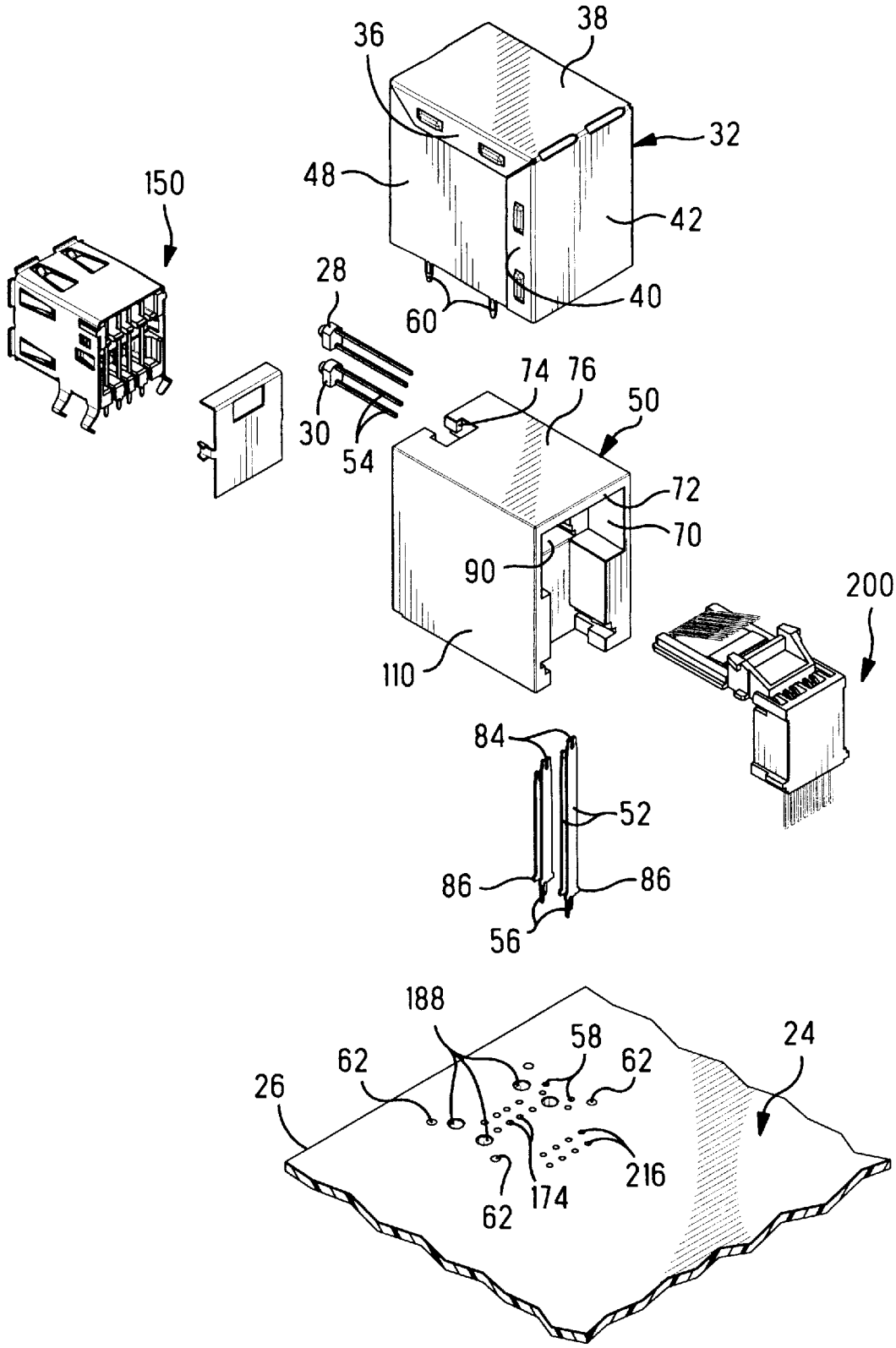

In FIGS. 2 and 3 is seen main housing 50 of insulative material, USB component 150, modular jack component 200, LEDs 28,30 and contacts 52 associated with respective ones of leads 54 of LEDs 28,30 for electrically interconnecting them by way of posts 56 to appropriate circuits of circuit board 24 at through holes 58. Outer shield 32 includes ground legs 60 insertable into respective through holes 62 of circuit board 24 for grounding. Outer shield 32 is shown in FIGS. 2 and 3 as being generally cubic in shape, although the shape shown is only achieved after the walls of the outer shield have been folded to envelope the assembly of the main housing and the LED, modular jack and stacked USB components therewithin, as described hereinbelow.

Main housing 50 (FIGS. 2 to 4) provides a first or USB component-receiving cavity 64 extending rearwardly thereinto from front face 66 for receipt thereinto of USB component 150; the main housing further includes a pair of LED-receiving apertures 68 for LEDs 28,30 extending rearwardly from front face 66, and a modular jack-receiving cavity 70 extending into rear face 72 for receipt thereinto of modular jack component 200. Main housing 50 also is seen to define second or modular plug-receiving cavity 14 associated with modular jack component 200 and extending rearwardly to communicate with modular jack-receiving cavity 70, and to define a latching section 74 along top wall 76 in communication with plug-receiving cavity 14 for latching thereinto of a latch arm of a modular plug connector (not shown) during mating.

Figure 4:
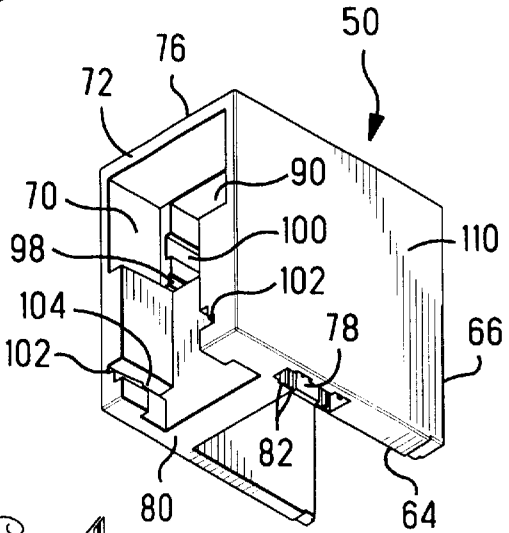
FIG. 4 is an isometric view of the main housing of the connector of FIGS. 1 to 3 from rearwardly and below thereof.
Figure 5:
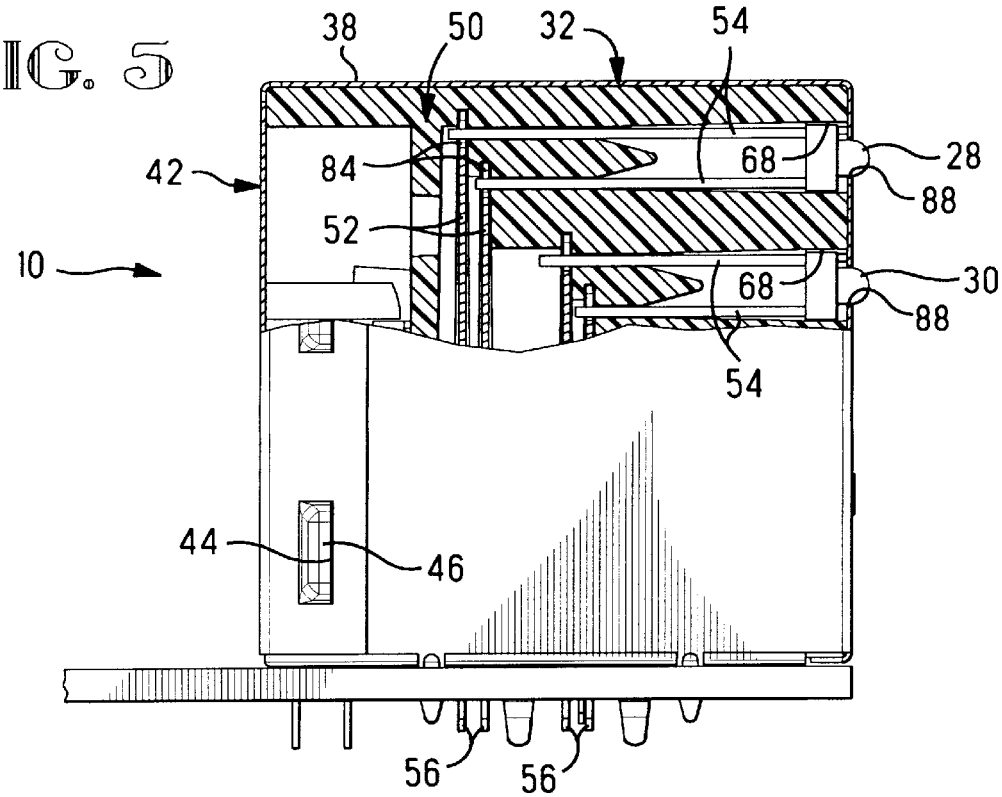
FIG. 5 is a cross-sectional view of the connector assembly taken along lines 5—5 of FIG. 1.

Main housing 50 is seen in FIGS. 4 and 5 to include a contact-receiving aperture 78 extending upwardly from bottom face 80, with pairs of opposed slots 82 adapted to receive LED contacts 52 therealong. After LEDs 28,30 are inserted into respective LED-receiving apertures 68, IDC slots 84 at upper ends of contacts 52 are received compressively around leads 54 to establish an electrical connection therewith. Pairs of opposed barbs 86 at lower ends of the contacts form an interference fit in slots 82 for retention of the contacts in main housing 50 after full insertion thereinto. The lenses of LEDs 28,30 extend forwardly through holes 88 in front shield wall 34, as seen in FIG. 5.

Referring now to FIGS. 4 and 3, modular jack-receiving cavity 70 of main housing 50 includes insert-receiving opening 90 extending forwardly from the upper portion of cavity 70 and is in communication with modular plug-receiving cavity 14 (FIG. 2).

Figure 7:
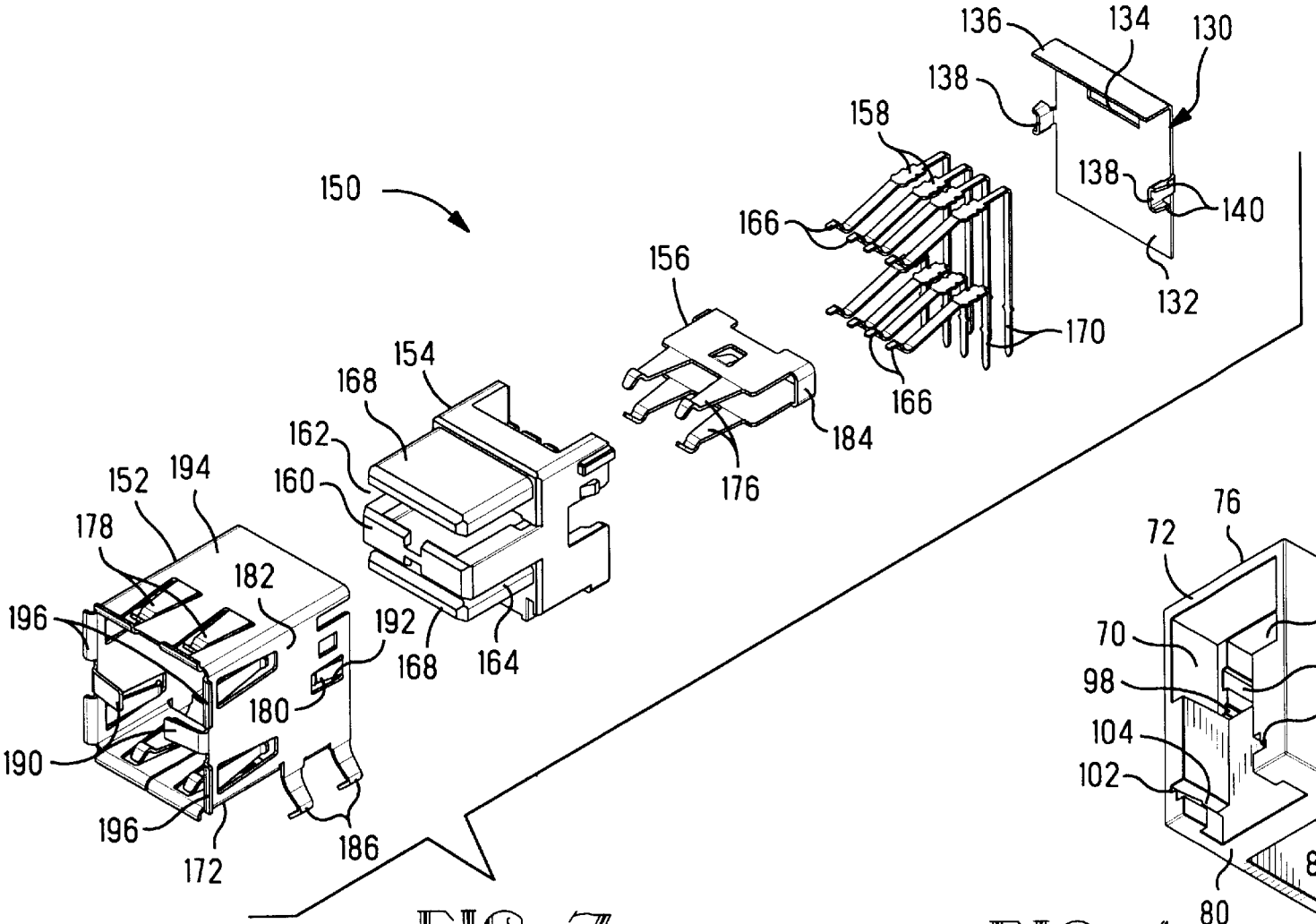
FIG. 7 is an exploded isometric view of the stacked USB component.

Stacked USB component 150 is shown in FIG. 7 to include an outer shield 152, an insulative housing 154, an inner shield 156 and a plurality of contacts 158. Partition 160 of housing 154 establishes a pair of plug-receiving cavities 162,164, and contacts 158 include contact sections 166 disposed along support walls 168 opposing partition 160 thereby being exposed in plug-receiving cavities 162,164 for electrical connection with contacts of the USB plug connectors (not shown). Contacts 158 further include board-connecting posts 170 that extend downwardly beyond board-mounting face 172 for electrical engagement with circuits of circuit board 24 at through holes 174 upon board mounting.

As disclosed in detail in PCT Patent Publication No. WO 97/10628, stacked USB component 150 includes inner shield 156 that includes spring arms 176 that extend along partition 160 to engage the shield of a mating USB plug connector along one side, while spring arms 178 of outer shield 152 engage the plug's shield along the opposite side for assured grounding. Additional spring arms 180 along side walls 182 of outer shield 152 engage webs 184 of inner shield 156 for grounding interconnection therewith, and outer shield 152 includes ground legs 186 depending beneath board-mounting face 172 for initial board retention and for electrical connection to a ground circuits of board 24 at holes 188. Further, outer shield 152 includes a pair of panel-engaging fingers 190 that extend toward each other forwardly of partition 160 to groundingly engage the panel portion extending horizontally between a pair of cutouts that provide for insertion of the USB plug connectors through the panel for connector mating.

Rear shield 130 is provided that is secured to outer shield 152 of USB component 150 along the rearward end thereof. Rear shield 130 has a rear plate 132, a window 134 through the top end of rear plate, and a top wall section 136 extending forwardly from the top edge of rear plate 132. Locking sections 138 extend forwardly from side edges of rear plate 132 that extend along inner surfaces of side walls 182 of outer shield 152 and are initially deflected inwardly toward each other during assembly, and locking sections 138 include pairs of locking tabs 140 extending outwardly to define a U-shape aligned with spring arms 180 and that seat in cutouts 192 in outer shield side walls 182 above and below spring arms 180, to lock the rear shield along the rearward end of USB component 150.

Figure 6:
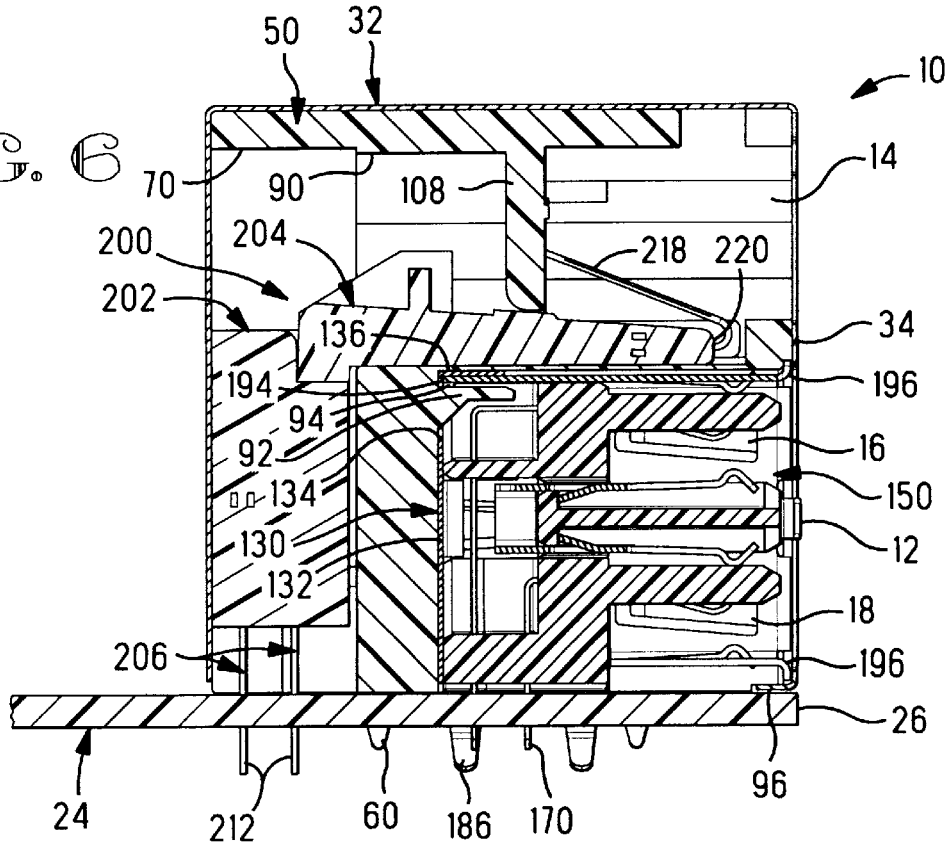
FIG. 6 is a cross-sectional view of the connector assembly taken along lines 6—6 of FIG. 1.

Stacked USB component 150 including rear shield 130 secured thereto, is mounted in main housing 50 as indicated in FIG. 6. Main housing 50 includes a projection 92 extending forwardly into USB component-receiving cavity 64 to define a slot 94 thereabove. Projection 92 is received through window 134 of rear shield 130, and slot 94 receives thereinto rear portion 194 of the upper wall of outer shield 152 and top wall section 136, establishing fixing of upper rear portion of USB component 150 against movement in the vertical direction; side walls of cavity 64 restrain its movement in the side-to-side direction; and the inner surface of front wall 34 of outer shield 32 is abutted by the outturned flanges 196 of the front wall of outer shield 152 of the USB component surrounding the apertures aligned with the plug-receiving openings 16,18. Bottom flange 96 extends rearwardly from the bottom edge of front shield wall 34 to retain the lower front portion of USB component 150 in the connector assembly.

Figure 9:
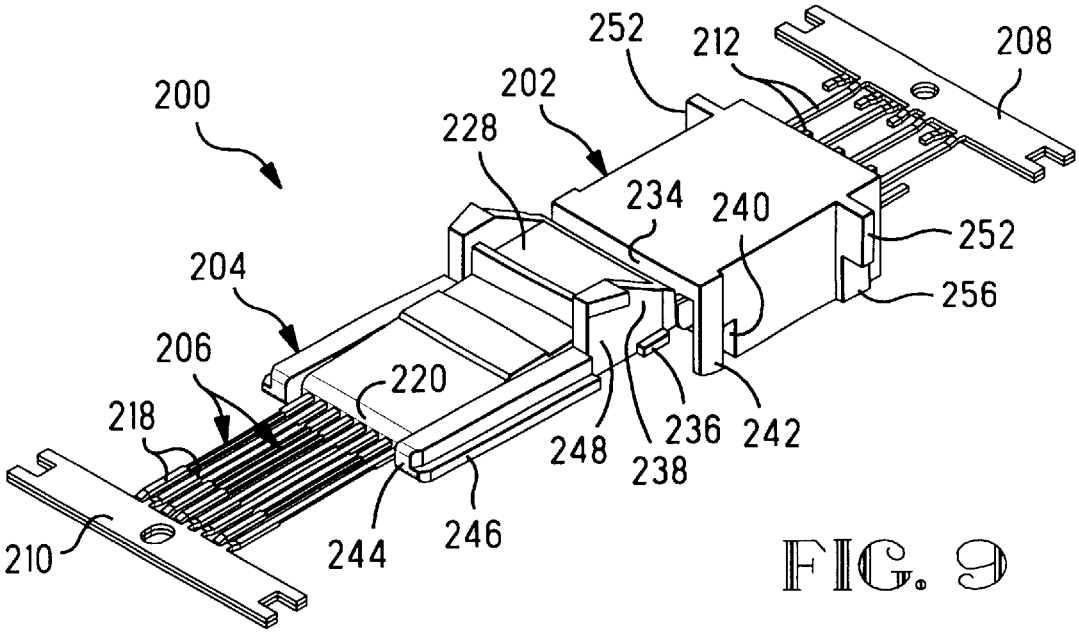
FIGS. 9 and 10 are isometric views illustrating the assembly of the modular jack component of FIG. 8.
Figure 10:
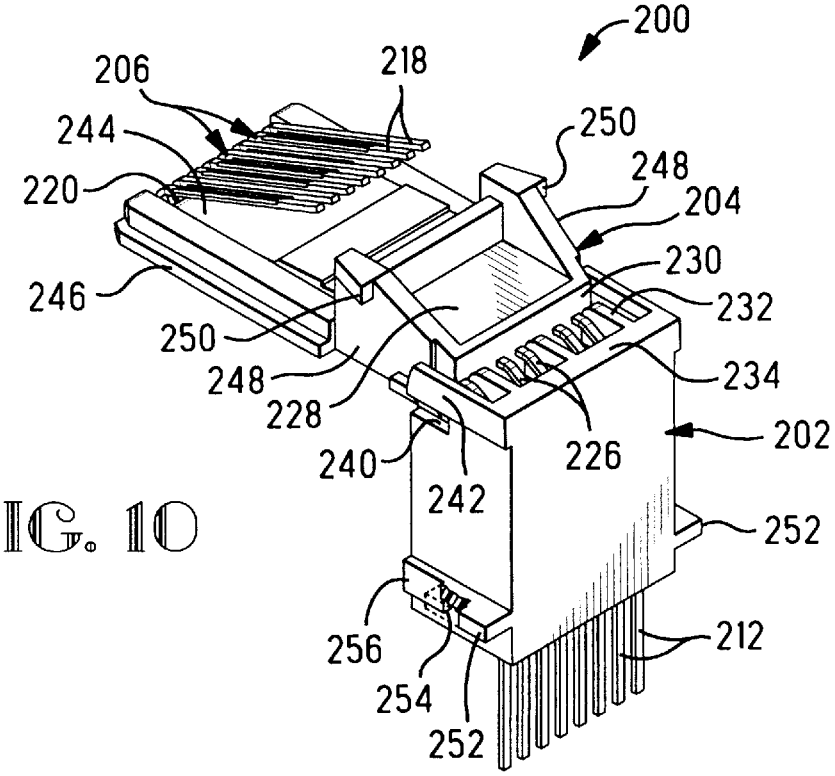
Figure 11:
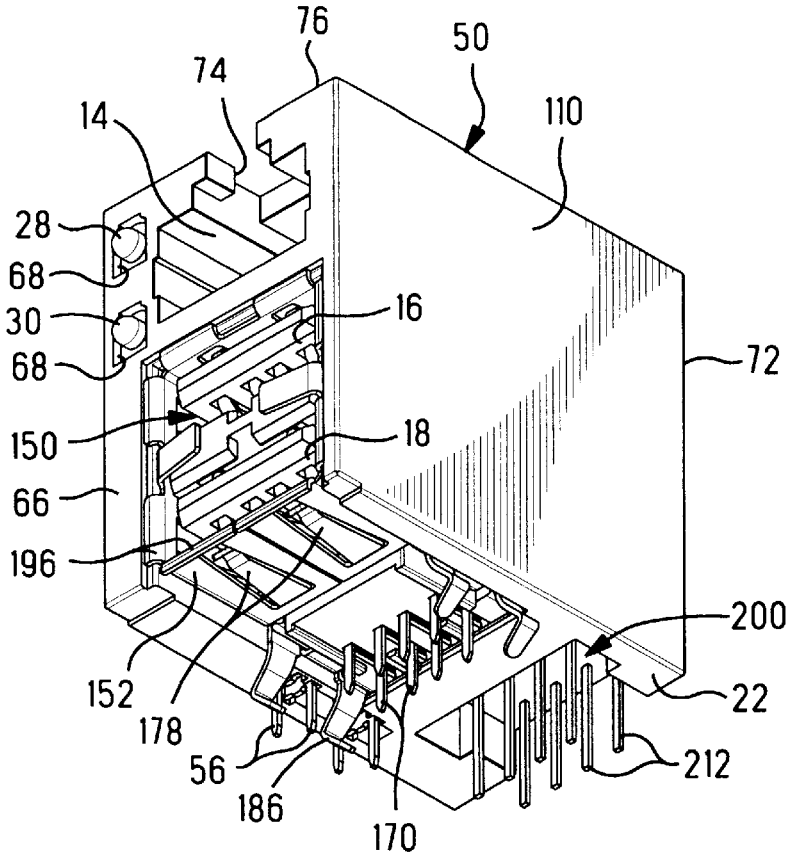
FIG. 11 is an isometric view of the stacked USB component assembled into the main housing of FIG. 4.
Figure 12:
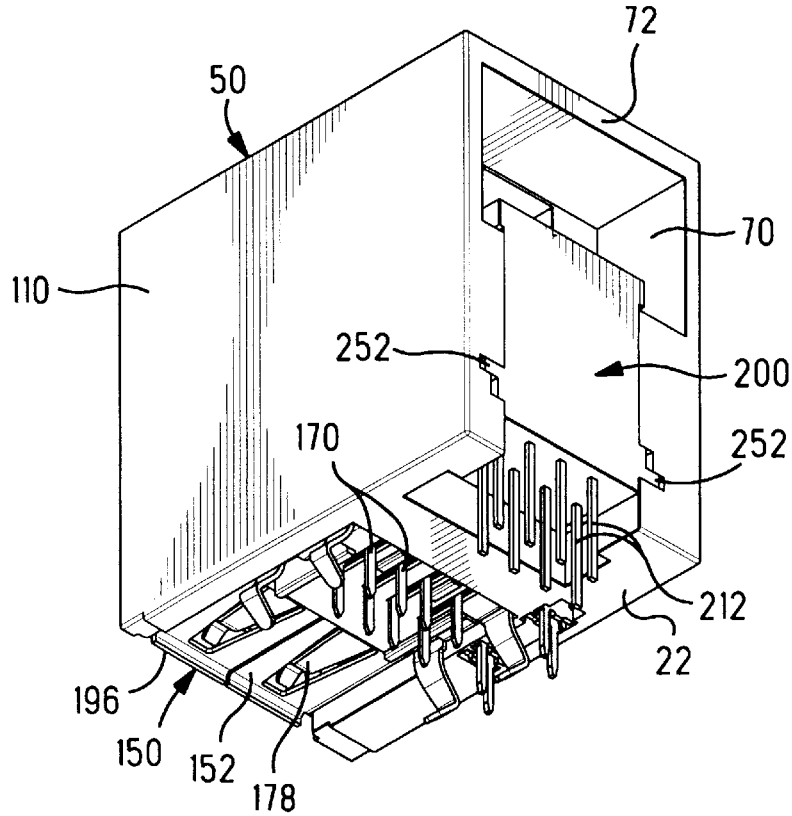
FIG. 12 is an isometric view of both the stacked USB and modular jack components assembled into the main housing of FIG. 4 prior to assembly of the outer shield.
Figure 13:
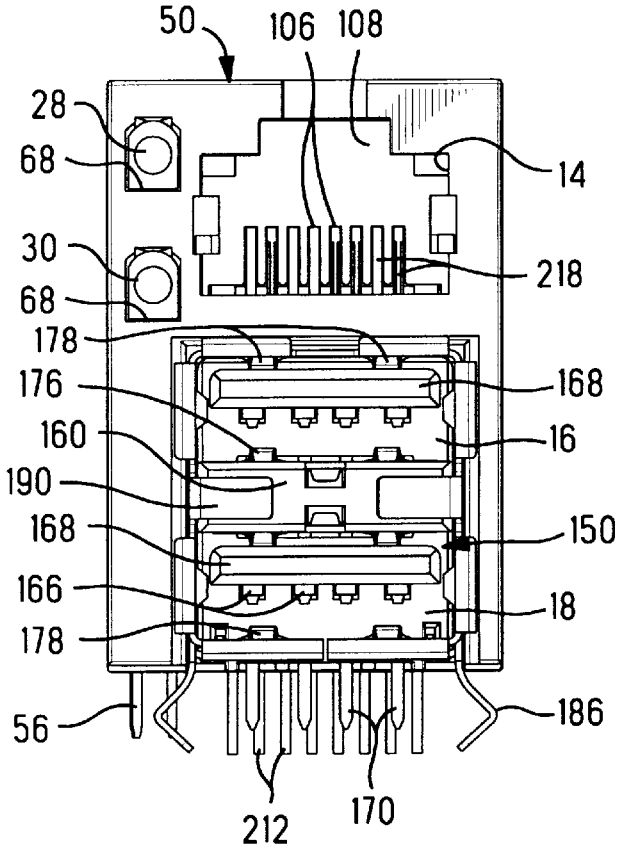
FIGS. 13 and 14 are front and rear elevation views of the assembly of FIG. 12 prior to assembly of the outer shield.
Figure 14:
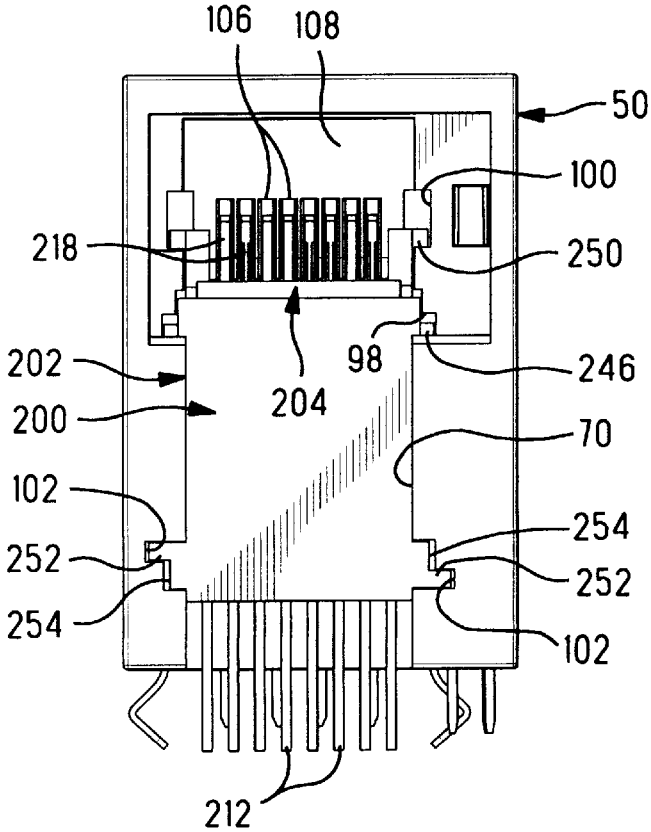

In FIGS. 8 to 10, modular jack component 200 includes a first housing 202, second housing or insert 204 and a plurality of contacts 206, with the first and second housings insert molded about portions of the body sections of the contacts. FIG. 8 is merely illustrative of the portions of component 200, since housings 202,204 do not exist as discrete members separate from the contacts in the preferred embodiment but are insert molded about the contacts. The contacts are initially stamped in carrier strip form, with both ends of each of the contacts initially joined to opposed carrier strips 208,210. Modular jack component 200 is similar to the connector disclosed in U.S. Pat. No. 5,362,257.

Contacts 206 include board-connecting posts 212 at first ends of body sections 214 that will depend beneath board-mounting face 22 for insertion into board through-holes 216 for connection to circuits of circuit board 24 (FIG. 2). At the opposed ends, contact sections 218 will be angled rearwardly from front nose 220 of insert 204 and disposed in modular plug-receiving cavity 14 upon complete assembly of stacked LAN connector 10 (see FIG. 6).

In FIG. 9, first and second housings 202,204 have been molded around respective first and second portions 222,224 of body sections 214 (prior to forming right angle bends 226 between the respective body section portions), so first and second housings 202,204 are initially generally coplanar, and carrier strips 208,210 have been severed from both ends of all contacts 206. Thereafter, the body sections of the contacts are bent into a right angle at bends 226 such that first housing 202 is oriented orthogonally to second housing 204 as is seen in FIG. 10.

Rearward end portion 228 of second housing 204 defines a rear face 230 that bears against rounded ribs 232 (FIG. 10) along top face 234 of first housing 202 during bending of the molded subassembly, whereafter latching projections 236 along side surfaces 238 enter recesses 240 to latch beneath arms 242 along sides of top face 234 to secure the second housing 204 in position at right angles to first housing 202, as seen in FIG. 10.

Second housing 204 includes a forward section 244 extending to a front end or nose 220, around which contacts 206 are bent to extend backwardly with contact sections 218 angled upwardly, as seen in FIG. 10. Forward section 244 of second housing 204 includes guide rails 246 that are inserted into main housing 50 and into guide slots 98 (FIG. 4) along side surfaces of opening 90 forwardly of jack-receiving cavity 70, when modular jack component 200 is inserted into main housing 50. Upstanding bosses 248 along sides of rearward section 228 include lateral flanges 250 that enter corresponding slots 100 above guide slots 98. First housing 202, now vertically oriented, includes guide rails 252 adjacent the bottom end thereof, that enter guide slots 102 along sides of cavity 70. Latch surfaces 254 are defined by embossments 256 along side surfaces of first housing 202 at forward ends of guide rails 252, that seat forwardly of latching ledges 104 also defined along sides of cavity 70 above guide slots 102, securing modular jack component 200 in position in main housing 50.

In assembling stacked LAN connector 10, preferably LEDs 28,30 and LED contacts 52 are assembled into main housing 50, then modular jack component 200 is assembled into main housing 50, after which stacked USB component 150 is inserted, all as seen in FIGS. 11 to 14. During insertion of modular jack component 200 into main housing 50, contact sections 218 pass through vertical slots 106 in transverse partition wall 108 (FIGS. 6 and 13) that also secure the free ends of contact sections 218 precisely in position biased against the upper ends of the slots to assure the desired angle when unmated, while allowing vertical movement as the contact sections are deflected downwardly by mating contacts upon insertion of a modular plug connector into cavity 14 during mating.

Thereafter, outer shield 32 is folded to envelope main housing 50 and secure stacked USB component 150 in position along mating face 12, by first positioning front wall 34 along front face 66 of main housing 50 with lenses of LEDs 28,30 protruding through corresponding holes 88. Bottom flange 96 of front wall 34 extends or is folded rearwardly against the front portion of the main housing along board mounting face 22, to lie beneath the front portion of stacked USB component 150 to cooperate in assuring the fixing of stacked USB component 150 against vertical movement, as seen in FIG. 6. Side walls 48 and top wall 38 extend or are folded rearwardly along housing sides 110 and top surface 76 respectively, whereafter rear wall 42 is folded down from the rear edge of top shield wall 38 to be disposed along rear face 72 of main housing 50. Flaps 36,40 are then folded along side shield walls 48 with embossments 46 locking in slots 44.

Figure 15:
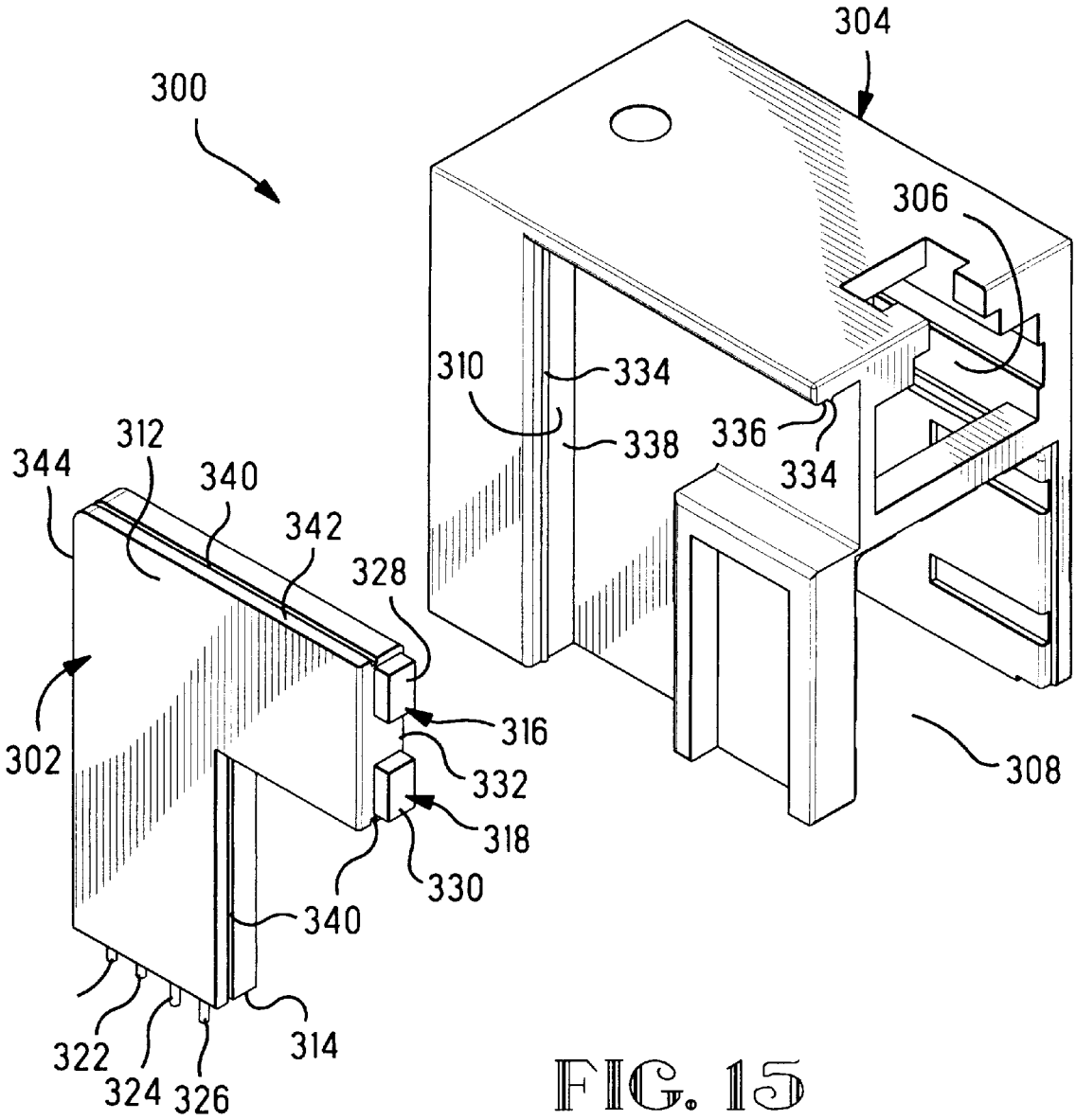
FIG. 15 is another embodiment of the housing for the stacked LAN connector for use with a module containing the LEDs.

The LEDs may be contained in an integral LED module, as shown in FIG. 15. The assembly 300 includes the LED module 302 and an insulative housing 304 similar to housing 50 of FIG. 2 in that it provides an upper plug-receiving cavity 306 and a lower USB component-receiving cavity 308. Along one side of housing 304 is defined an inverted L-shaped recess 310, into which LED module 302 is inserted. LED module 302 comprises an outer covering 312 that embeds therewithin a pair of leaded LED components 316,318 similar to LEDs 28,30 of FIG. 2, except that the LED components have longer leads to extend beneath board-adjacent surface 314 to define contact sections 320, 322,324,326 that are solderable into plated-through holes of the board, or that may be modified for surface mounting if desired. Lenses 328,330 of the LED components extend forwardly of front surface 332 of module 302 to serve as visual indicators, as with connector assembly 10 of FIGS. 1 to 14.

LED module 302 may be easily affixed to housing 304 in a snap fit in recess 310 such as by use of resiliently compressible protrusions such as tongues 334 along at least one horizontal side wall 336 and one vertical side wall 338 of recess 310, that are snap-fitted into corresponding indentations such as grooves 340 along outwardly facing horizontal and vertical surfaces or walls 342,344 of LED module 302. It may be seen that LED module 302 and its latching sections (grooves 340) maintain a minimized width in cooperation with recess 310 and its cooperating latching sections (tongues 334), and thereby necessitate only a minimal increase in the overall width of the connector housing. The assembly 300 may then be shielded as in FIGS. 1 to 14.

In the present invention, a conventional stacked USB connector is accommodated without modification in the stacked LAN connector. A shield member is secured to the rearward end of the USB connector without modification thereto, for shielding between the USB component contacts and the mod jack contacts. Substantial savings in circuit board real estate result in placing the modular jack component above the stacked USB connector, so that the connector accommodates either LAN or peripheral connections or both simultaneously, while internal and external shielding of the contacts of both the modular jack and stacked USB components assures the integrity of the signals transmitted from mating connectors to the circuits of the circuit board. Convenience results from providing an assembly that is manipulatable as a unit for board placement, such as by pick-and-place equipment prior to soldering of the contacts and shield ground sections to the circuits of the circuit board.

Modifications and variations may be made to the specific embodiment disclosed herein, that are within the spirit of the invention and the scope of the claims.

What is claimed is:

1. An electrical connector, comprising:

a board-mountable assembly having an insulative housing, said insulative housing defining a first aperture, a second aperture, a mating face and a board-mounting face;

a shielded electrical connector insertable into said first aperture and including at least one first plug-receiving cavity in communication with said mating face of said assembly, and further including a first array of board-connectable contacts having contact sections exposed in each said at least one first plug-receiving cavity of said shielded electrical connector;

a second array of board-connectable contacts disposed in said insulative housing and having contact sections exposed in a second plug-receiving cavity in communication with said mating face of said assembly;

said second plug-receiving cavity and each said at least one first plug-receiving cavity being vertically stacked, and board-connecting contacts sections of said first array of contacts and said second array of contacts extending vertically at least to said board-mounting face of said insulative housing remote from said mating face;

a shield in said insulative housing between said board-connecting contact sections of said first array of contacts and said second array of contacts; and an outer shield affixed around said insulative housing and exposing said mating face and said board-mounting face, wherein flaps of a top wall of said outer shield and flaps of a rear wall of said outer shield include slots that lock over embossments of side walls of said shield when said flaps are folded to coextend along portions of said side walls adjacent thereto, upon assembly of said shield around said insulative housing, to secure said outer shield around said insulative housing.

2. The electrical connector of claim 1 wherein said insulative housing includes a pair of LEDs secured therein, each said LED including a light-emitting lens exposed along said mating face and further including leads extending at least to said board-mounting face of said insulative housing.

3. The electrical connector of claim 2 wherein each said LED includes a pair of leads extending rearwardly therefrom, said insulative housing includes a pair of LED-receiving apertures into said mating face and a pair of lead-receiving openings extending rearwardly from each said LED-receiving aperture, a contact-receiving opening extending upwardly from said board-mounting face intersecting said lead-receiving openings, and board-connecting contacts insertable into said contact-receiving opening at selected positions therewithin and in electrical engagement with respective ones of said LED leads after insertion into said contact-receiving openings.

4. The electrical connector of claim 2 wherein said LEDs are contained in an insert of insulative material that is affixed in a recess extending into an outer side surface of said insulative housing.

5. The electrical connector of claim 4 wherein said recess is shaped as an inverted L and includes an upper wall and opposed vertical walls, said insert is complementary in shape to said recess, said insert includes a groove into a top surface thereof and at least one vertical wall, and said upper wall and at least one said vertical wall of said recess include respective tongues for snapping into respective grooves of said insert, to retain said insert in said recess.

6. An electrical connector, comprising:

a board-mountable assembly having an insulative housing, said insulative housing defining a first aperture, a second aperture, a mating face and a board-mounting face, wherein said first aperture extends into said insulative housing from said mating face and is adjacent to and in communication with said board-mounting face;

a shielded electrical connector insertable into said first aperture and including at least one first plug-receiving cavity in communication with said mating face of said assembly, and further including a first array of board-connectable contacts having contact sections exposed in each said at least one first plug-receiving cavity of said shielded electrical connector;

a second array of board-connectable contacts disposed in said insulative housing and having contact sections exposed in a second plug-receiving cavity in communication with said mating face of said assembly;

said second plug-receiving cavity and each said at least one first plug-receiving cavity being vertically stacked, and board-connecting contacts sections of said first array of contacts and said second array of contacts extending vertically at least to said board-mounting face of said insulative housing remote from said mating face; and a shield in said insulative housing between said board-connecting contact sections of said first array of contacts and said second array of contacts.

7. The electrical connector of claim 6 wherein said shielded electrical connector is a stacked Universal Serial Bus Connector defining two plug-receiving cavities along a mating face thereof.

8. The electrical connector of claim 7 wherein said shield between said board-connecting sections of said first and second arrays of contacts is a rear shield affixed along a rear face of said shielded electrical connector rearwardly of board-connecting sections of said first array of contacts, electrically connected with an outer shield of said shielded electrical connector.

9. The electrical connector of claim 8 wherein said rear shield includes a window along a rear plate thereof, and a projection extends forwardly into said first aperture from a rear wall of said first aperture and through said window upon insertion of said shielded electrical connector into said first aperture to assist in retention of said shielded electrical connector in said first aperture.

10. The electrical connector of claim 9 wherein an outer shield surrounding said insulative housing includes a front wall surrounding said first and second apertures, and a portion of an outer shield of said shielded electrical connector abuts portions of said front wall of said outer shield of said assembly adjacent said first aperture to assist in retention of said shielded electrical connector in said first aperture.

11. An electrical connector, comprising:

a board-mountable assembly having an insulative housing, said insulative housing defining a first aperture, a second aperture, a mating face and a board-mounting face, wherein said second aperture is a modular jack cavity adjacent said mating face of said insulative housing, for receiving thereinto a complementary modular plug and wherein said insulative housing includes a jack-receiving cavity extending into a rear face thereof, said jack-receiving cavity having an opening in communication with said second aperture;

a shielded electrical connector insertable into said first aperture and including at least one first plug-receiving cavity in communication with said mating face of said assembly, and further including a first array of board-connectable contacts having contact sections exposed in each said at least one first plug-receiving cavity of said shielded electrical connector;

a second array of board-connectable contacts disposed in said insulative housing and having contact sections exposed in a second plug-receiving cavity in communication with said mating face of said assembly;

said second plug-receiving cavity and each said at least one first plug-receiving cavity being vertically stacked, and board-connecting contacts sections of said first array of contacts and said second array of contacts extending vertically at least to said board-mounting face of said insulative housing remote from said mating face; and a shield in said insulative housing between said board-connecting contact sections of said first array of contacts and said second array of contacts.

12. The electrical connector of claim 11 wherein a modular jack component is insertable into said jack-receiving cavity with a forward portion extending into said second aperture, said forward portion carrying contact sections of said second array of contacts to be disposed in said second aperture for mating with said modular plug.

13. The electrical connector of claim 12 wherein said insulative housing defines a transverse partition wall above said opening and defining a rear wall of said second aperture, said partition wall includes slots extending to said opening and at least open to said second aperture, and free ends of said contact sections of said second array of contacts are disposed in respective said slots to maintain said free ends in appropriate position upon assembly and when being deflected during mating and unmating with corresponding contacts of a mating modular plug connector.

14. The electrical connector of claim 12 wherein said insulative housing further includes guide slots along side surfaces of said opening, and said forward portion of said modular jack component includes guide rails that follow said guide slots when said modular jack component is inserted into said insulative housing.

15. The electrical connector of claim 11 wherein said modular jack component includes a vertical housing portion surrounding vertical sections of said second array of contacts, and said jack-receiving cavity extends vertically to be in communication with said board-mounting face of said insulative housing to receive said vertical housing portion of said modular jack component.

16. The electrical connector of claim 15 wherein said jack-receiving cavity includes guide slots proximate said board-mounting face, and said vertical housing portion of said modular jack component includes guide rails that follow said guide slots upon insertion of said modular jack component into said insulative housing, and embossments at forward ends of said guide rails seat forwardly of latching ledges defined adjacent said guide slots, to secure said modular jack component in said insulative housing.

17. A stacked LAN electrical connector, comprising:

a board-mountable assembly including an insulative housing having a vertical axis, said insulative housing defining at least a first aperture and a second aperture stacked vertically, a mating face and a board-mounting face;

a first electrical connector disposed in said first aperture including a first array of board-connectable contacts having contact sections exposed in a first plug-receiving cavity in communication with said mating face of said assembly; and a second electrical connector, dissimilar from said first electrical connector, disposed in said second aperture, said second connector including a second array of board-connectable contacts disposed in said insulative housing and having contact sections exposed in a second plug-receiving cavity in communication with said mating face of said assembly.

18. The stacked LAN electrical connector of claim 17 further comprising:

a module affixable to said insulative housing and containing at least one LED having a lens exposed at said mating face and board-connecting contact sections exposed at said board-mounting face;

wherein said insulative housing defines a module-receiving recess into a sidewall thereof, said recess being in communication with said mating face and said board mounting face and having an inverted L-shape, said recess including tongues defined on at least one horizontal wall and at least one vertical wall, and said module including tongue-receiving grooves defined on at least one horizontal wall and at least one vertical wall; and whereby said module is snappable into said recess when said tongues enter said grooves.

19. The stacked electrical connector of claim 17 wherein said first electrical connector is a USB connector.

20. The stacked electrical connector of claim 19 wherein said second electrical connector is a modular jack connector.

21. The stacked LAN electrical connector of claim 20 wherein an outer shield is affixed around said insulative housing to shield both said USB connector and said modular jack connector.

22. The stacked LAN electrical connector of claim 20 wherein a pair of LEDs are affixed in said insulative housing with board-connecting contact sections extending at least to said board-mounting face of said insulative housing.

23. The stacked LAN electrical connector of claim 20 wherein said modular jack connector is positioned above said USB connector.

24. The stacked LAN electrical connector of claim 23 wherein said USB connector is a stacked USB connector having two plug-receiving cavities and is insertable into said first aperture from said mating face.

25. The stacked LAN electrical connector of claim 23 wherein said modular jack connector includes a modular jack component insertable into said insulative housing from rearwardly thereof and includes a vertical portion disposed rearwardly of said USB connector and containing vertical portions of said second array of contacts.

26. A method of affixing a module to an electrical connector, comprising the steps of:

providing an electrical connector having an insulative housing with an outer side wall having a component-receiving recess thereinto, said recess having side wall surfaces with first latching sections therealong;

providing a module having side wall surfaces with second latching sections therealong, with one of said first and second latching sections being resiliently compressible and protruding from a respective one of said recess side wall surfaces and said module side wall surfaces, and the other thereof being a complementary indentation defining a seat; and pressing said electrical component into said recess into said housing side wall with said recess side wall surfaces against said component side wall surfaces and said protruding latching section being compressed until seating within said indentation latching section, thereby engaging said first and second latching sections.

* * * * *